US010590631B2

(12) United States Patent
Keighley et al.

(10) Patent No.: US 10,590,631 B2
(45) Date of Patent: Mar. 17, 2020

(54) VISUAL INDICATOR FOR A COUPLER

(71) Applicant: Wedgelock Equipment Limited, Upper Hutt (NZ)

(72) Inventors: Garth Colin Keighley, Upper Hutt (NZ); Andrew James Phillip Rider, Te Horo (NZ); Ashley Craig Gibson, Wellington (NZ)

(73) Assignee: WEDGELOCK EQUIPMENT LIMITED, Upper Hutt (NZ)

( * ) Notice: Subject to any disclaimer, the term of this patent is extended or adjusted under 35 U.S.C. 154(b) by 87 days.

(21) Appl. No.: 15/560,294

(22) PCT Filed: Mar. 23, 2016

(86) PCT No.: PCT/NZ2016/050044
§ 371 (c)(1),
(2) Date: Sep. 21, 2017

(87) PCT Pub. No.: WO2016/153360
PCT Pub. Date: Sep. 29, 2016

(65) Prior Publication Data

US 2018/0066418 A1 Mar. 8, 2018

(30) Foreign Application Priority Data

Mar. 25, 2015 (NZ) ..... 706315

(51) Int. Cl.
*E02F 9/26* (2006.01)
*E02F 3/36* (2006.01)

(52) U.S. Cl.
CPC ..... *E02F 9/26* (2013.01); *E02F 3/364* (2013.01); *E02F 3/3627* (2013.01); *E02F 3/3663* (2013.01)

(58) Field of Classification Search
CPC . E02F 9/26; E02F 3/3627; E02F 3/364; E02F 3/3663
See application file for complete search history.

(56) References Cited

U.S. PATENT DOCUMENTS 5,010,962 A * 4/1991 Bloom, Jr. ..... E02F 3/3604 116/281
5,692,850 A 12/1997 Kimble et al.
(Continued)

FOREIGN PATENT DOCUMENTS

NZ 546893 A 2/2008
WO 2002/097201 A1 12/2002

OTHER PUBLICATIONS

International Search Report and Written Opinion received for PCT Patent Application No. PCT/NZ2016/050044, dated May 10, 2016, 13 pages.

(Continued)

*Primary Examiner* — Jamie L McGowan
(74) *Attorney, Agent, or Firm* — Womble Bond Dickinson (US) LLP

(57) ABSTRACT

An indicator for a quick coupler for the mounting of an attachment to an earth working machine. The indicator (10) has a sensor (14,15) which, in response to movement of a movable pin engagement component (F) of a coupler (A), determines that the pin engagement component (F) will have moved sufficiently to engage and lock a pin (P2) of an attachment with the coupler (A). The indicator (10) has an indicating part (17) which is caused to be moved in response to the sensor (14,15) to thereby provide a visual indication (25) that engagement and locking of the pin (P2) has occurred.

20 Claims, 11 Drawing Sheets

(56) References Cited

U.S. PATENT DOCUMENTS

| | | | | |
|---|---|---|---|---|
| 6,699,001 | B2 * | 3/2004 | Fatemi | E02F 3/3618 37/468 |
| 6,964,122 | B2 * | 11/2005 | Cunningham | E02F 3/3618 37/468 |
| 7,032,335 | B2 * | 4/2006 | Short | E02F 3/3618 37/403 |
| 7,059,072 | B2 * | 6/2006 | Archuleta, Jr. | E02F 3/40 299/26 |
| 7,493,712 | B2 * | 2/2009 | McCormick | E02F 3/3618 37/468 |
| 7,984,576 | B2 * | 7/2011 | Miller | E02F 3/3618 37/468 |
| 8,112,914 | B2 * | 2/2012 | Miller | E02F 3/3618 37/468 |
| 8,549,775 | B2 * | 10/2013 | Lanting | E02F 3/3631 37/468 |
| 2014/0064824 | A1 * | 3/2014 | Nilsson | E02F 3/3627 403/27 |

OTHER PUBLICATIONS

International Preliminary Report on Patentability received for PCT Patent Application No. PCT/NZ2016/050044, dated Oct. 5, 2017, 9 pages.

* cited by examiner

VISUAL INDICATOR FOR A COUPLER

BACKGROUND OF THE INVENTION

This invention relates to an indicator.

Quick couplers for mounting an attachment, e.g. a bucket, to an earth working machine, such as an excavator, are known. A potential danger with a quick coupler is that the coupler can fail to hold the attachment at one or both of the mounting points with the result that the attachment can either fall off the coupler or swing down from the coupler.

The failure to correctly hold the attachment in place can be due to a variety of reasons. If the quick coupler is hydraulically operated an hydraulic failure can result in the quick coupler failing to retain the attachment in a working position. Another reason can be failure to correctly locate a pin of the attachment in the coupler. For example, when the pin is retained by a sliding wedge component, failure to fully locate the pin in the recess in the coupler can result in the wedge sliding over rather than under the pin. Consequently the pin will not be locked in the recess.

The consequences of such failures can be injury to, or death of, someone in the vicinity of the attachment.

When the coupler is mounted to the earth working machine such as an excavator, one end (usually referred to as the front end because it is closest to the operator) is readily visible to the operator. Thus it is usually the case that the correct location of the pin in the front recess of the coupler and subsequent locking of the pin in the recess is visually apparent to the operator.

However, the location and locking of the rear pin of the attachment in the rear recess of the coupler is not visible to the operator. Therefore there is a need for some form of indicator whereby an operator has a visual indication that the rear pin is engaged and locked prior to operating the machine to lift the attachment.

SUMMARY OF THE INVENTION

An object of the present invention is thus to provide an indicator for a quick coupler which provides a visual indication of the engagement of a pin of an attachment in the quick coupler when the engagement of the pin is not readily visible to an operator or to at least provide the public with a useful choice.

The inventive concept which achieves this object broadly resides in an indicator that has a sensor which, in response to movement of a movable pin engagement means of a coupler, determines that the pin engagement means will have moved sufficiently to engage and lock a pin of an attachment with the coupler, and an indicator means which is caused to be moved in response to the sensor to thereby provide a visual indication that engagement and locking of the pin has occurred.

Broadly according to one aspect of the invention there is provided an indicator which includes a combination of a profiled surface and a follower one of which is adapted to be coupled to a movable pin engagement means of a quick coupler and the other of which is coupled to a visual indicator means that is, in use, movable in response to relative movement between the profiled surface and follower to thereby provide a visual indication of the engagement between the engagement means and a pin of an attachment.

Broadly in a second aspect of the invention there is provided a quick coupler that includes the visual indicator according to the first broad aspect.

In a preferred form of the invention the follower is coupled to the movable pin attachment means.

In a preferred form of the invention the profiled surface is coupled to the visual indicator element.

In a preferred form the movable pin attachment means is a movable wedge.

In a preferred form the movable wedge is driven by an hydraulic mover.

Preferably the follower is connected to a coupling which couples the wedge to the hydraulic mover.

In a preferred form of the invention the profiled surface is coupled to a pivotally mounted lever.

Preferably in one form of the invention the lever is connected to the visual indicator means.

In one form of the invention the visual indicator means is formed as an integral part of the lever. In the preferred form a end part of the lever forms the indicator means.

In the preferred form of the invention the profiled surface is of a profile that causes movement of the visual indicator means to occur when the relative movement between the profiled surface and the follower corresponds with movement of the pin engagement means sufficient to engage and lock the pin.

BRIEF DESCRIPTION OF THE DRAWINGS

In the following more detailed description of embodiments of the invention and its application to a quick coupler reference will be made to the drawings which form part of this specification and in which:

FIG. 29 is a sectioned side elevation view similar to FIG. 19 but showing quick coupler in a state that corresponds to the wedge extended and the attachment locked.

DESCRIPTION OF PREFERRED EMBODIMENTS OF THE INVENTION

The indicator according to the present invention will be described herein in relation to one form of quick coupler but it will be appreciated by the skilled addressee that the indicator can be used in other forms of quick coupler.

Figure 1:
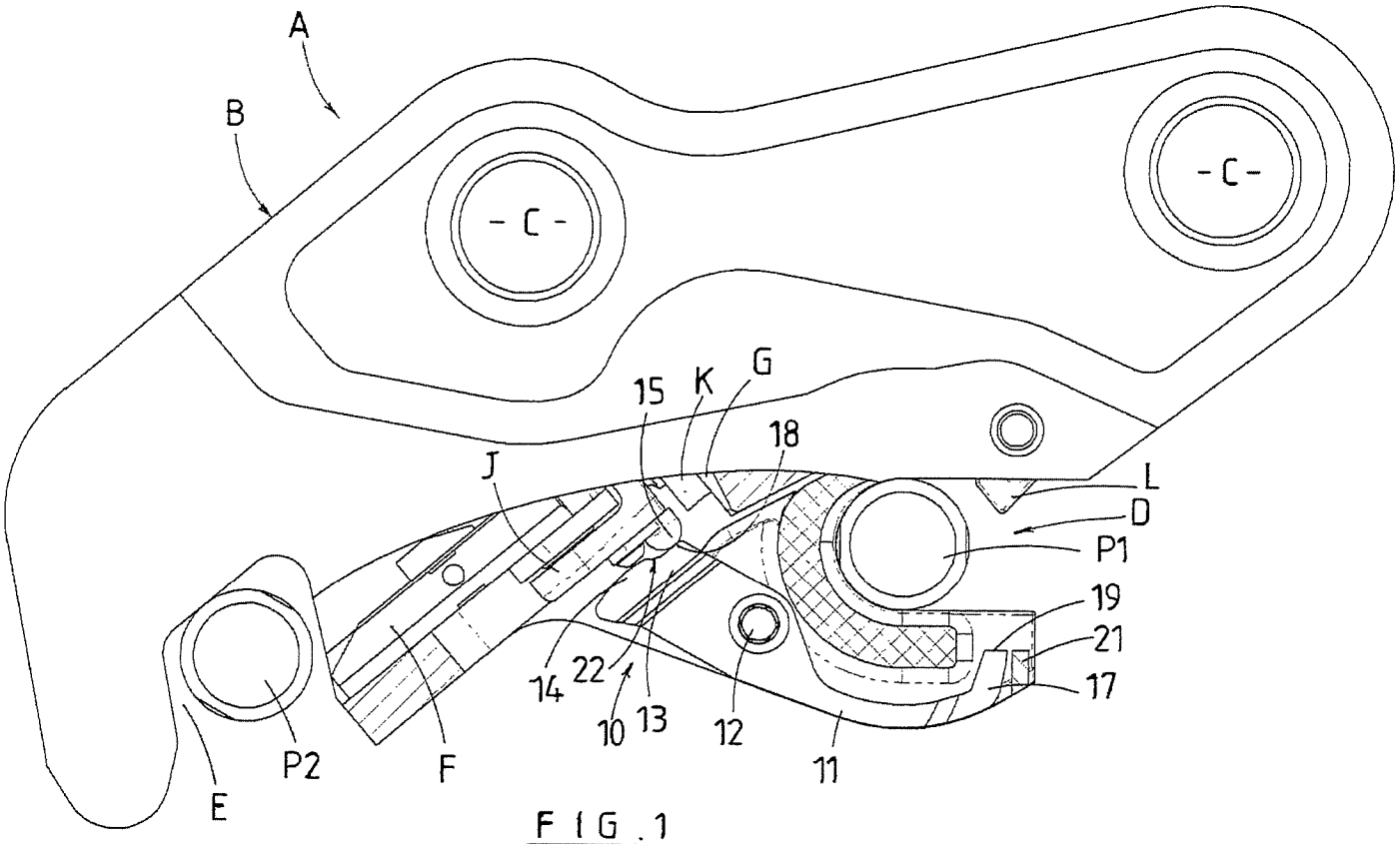
FIG. 1 is a side elevation partially cut away view of an hydraulic quick coupler with a wedge form of pin engagement means incorporating an indicator in accordance with the present invention.

The quick coupler as shown in FIG. 1 of the drawings is a known form of quick coupler A made by our company and a first embodiment of the indicator 10 of the present invention when incorporated in the quick coupler. The quick coupler A is operated hydraulically by the hydraulics of the machine (e.g. excavator) to which the coupler is attached. The body B of the quick coupler has mounting points C whereby the quick coupler can be attached to say the arm of an excavator (not shown).

The body B has a hook shaped recess D in part of the body B and into which one of the mounting pins P1 of an attachment engages. The hook shaped recess end of the quick coupler is typically referred to as the "front" of the coupler as this is the end of the coupler that will face toward the operator of the machine (e.g. excavator).

Another mounting pin P2 of the attachment locates in the "C" recess E (at the so called "rear" of the coupler). An hydraulically powered engagement element such as a wedge or tongue F (hereinafter "wedge F") is extendible to capture the rear mounting pin P2 of the attachment in the recess E.

Figure 2:
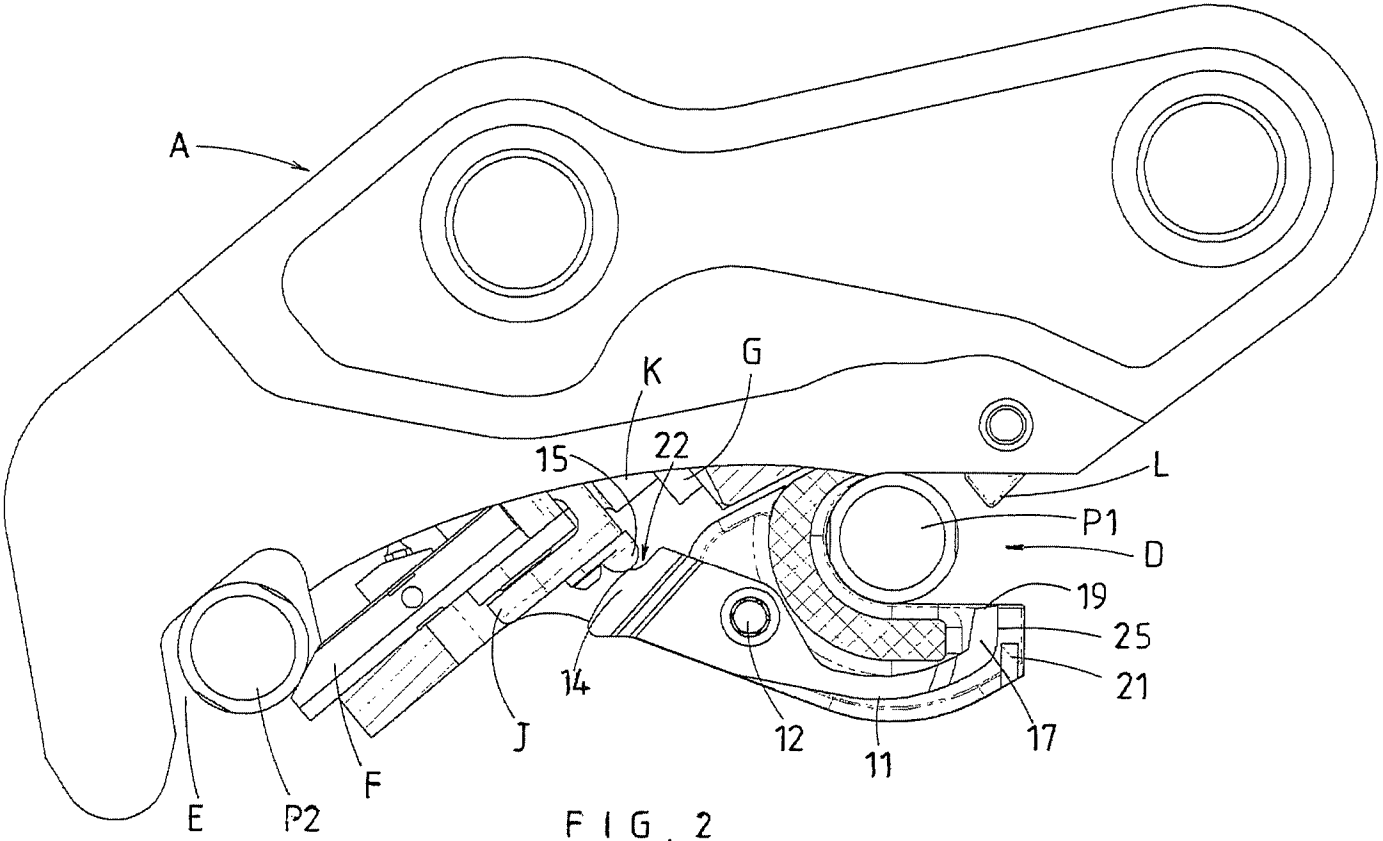
FIG. 2 is a further side elevation view similar to FIG. 1 but showing the wedge having moved into engagement with the attachment pin in the rear recess of the coupler.

Thus the excavator operator will position recess D of the coupler onto the front pin P1 of the attachment and then "crowd" the coupler such that the rear pin P2 engages in the recess E (the pins being so engaged are shown in FIGS. 1 and 2). The wedge F is then extended to engage with and lock the rear pin P2 in the recess E. The attachment is thereby coupled to the coupler A in its working position as shown in FIG. 2.

Thus if, for example, the hydraulic power to the coupler A fails the wedge F can retract which will enable release of the mounting pin P2 from the recess E to occur. Alternatively, if the rear pin P2 is not correctly located into the recess E the wedge F will fail to lock the rear pin in place. If the front pin P1 in the hook shaped part D is not retained in position the attachment can fall from the excavator arm. However, if the front pin is retained (by say our I Lock device L as described and claimed in our New Zealand patent specification 552294/546893) then the attachment will not fall completely off the coupler A but will swing down on the pin P1.

In the form of coupler A shown in FIG. 1 the wedge F is part of an operating means formed by hydraulic cylinder G which controls the extension and retraction of the wedge F. This is only one example of the form that the cylinder G and wedge F arrangement may take. In FIGS. 9, 12, 14 and 16 of the drawings only the piston rod of the cylinder is shown.

According to the present invention the indicator 10 provides a visual indication to the machine operator that the wedge F has moved to an engagement position and locked the rear pin P2 in the recess E. Also in the preferred form of the invention the indicator can provide a visual indication that the wedge F and/or rear pin P2 is worn and in need of repair/replacement.

The indicator 10 of the present invention can also provide a visual indication of hydraulic failure resulting in at least partial retraction of the wedge F to thereby alert the operator that the attachment mounted by the quick coupler is no longer retained in a working position on the coupler.

In FIGS. 1 and 2 the indicator 10 is shown as part of the coupler however, in FIGS. 9, 11, 12 to 15 and 16 the indicator 10 is shown in conjunction with only parts of the quick coupler namely the section H of the quick coupler body that incorporates the hook shaped recess D, a bifurcated coupling J (to which the wedge F is coupled) and the piston rod K of the hydraulic cylinder which controls the extension and retraction of the wedge F.

Figure 3:
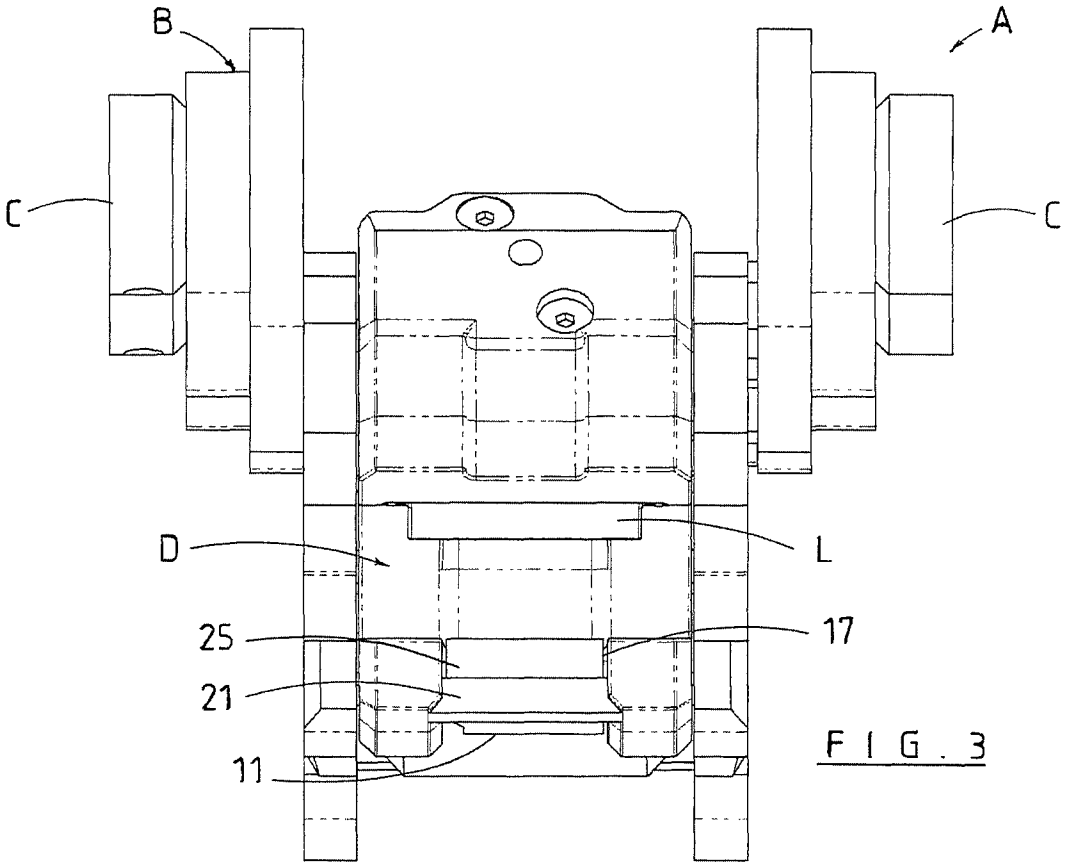
FIG. 3 is a view of the front end of the coupler showing the indicator in a position corresponding to that of FIGS. 1 and 2.
Figure 4:
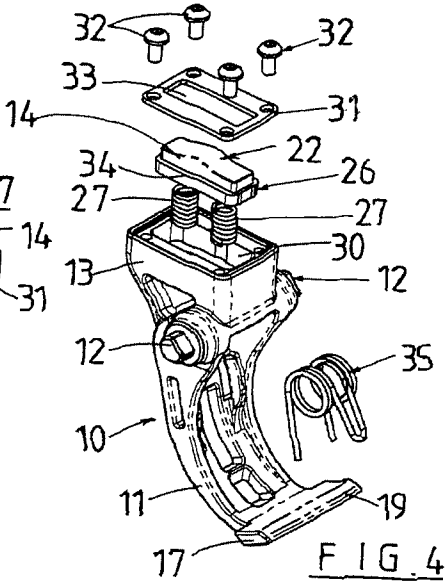
FIG. 4 is an exploded isometric view of a second embodiment of the indicator according to the invention.
Figure 7:
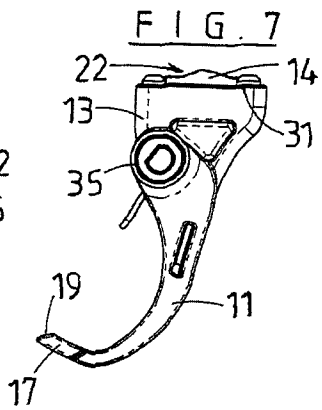
FIG. 7 is a side elevation view of the other side of the indicator to that shown in FIG. 5.
Figure 6:
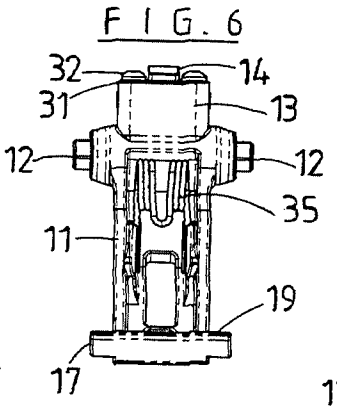
FIG. 6 is a front elevation view of the indicator as shown in FIG. 4.
Figure 5:
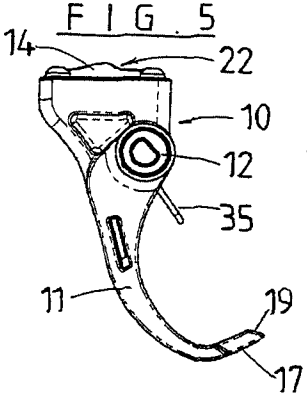
FIG. 5 is a side elevation view of the indicator as shown in FIG. 4.
Figure 8:
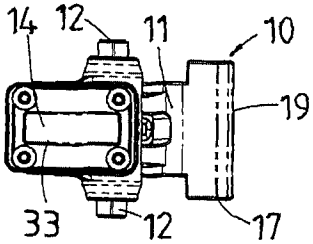
FIG. 8 is a top plan view of the indicator as shown in FIG. 4.

Referring to FIGS. 1 to 3 the indicator 10 is shown in accordance with one embodiment of the invention. The indicator 10 includes a lever 11 which is mounted to the coupler so as to be pivotable about a pivot pin 12. One end 13 (the inner end) is formed with (or has attached to) a cam profile 14. A follower 15 for engagement with the cam profile 14 is formed with (or has coupled thereto) the coupling J.

It will be appreciated by the skilled addressee that the follower 15 is intended to move in response to movement of the wedge F thus the follower 15 could be attached to some part of the wedge F or otherwise coupled to the wedge or the wedge operating mechanism e.g. cylinder piston rod or body. As a consequence the shape of the lever 11 at the cam end 13 would need to be altered to be correctly positioned to engage with the follower 15.

Other configurations may be necessary to accommodate different mechanisms in other forms of quick couplers whether they have a moving wedge, sliding jaw or other mechanisms for capturing the rear pin of an attachment.

At the distal or outer end 19 of the lever 11 is an indicator portion 17 the purpose of which will hereinafter become apparent. This indicator portion 17 is preferably located at part of the coupler so as to be readily visible to the operator of the machine (e.g. excavator) to which the quick coupler is mounted. In the preferred form shown in the drawings the indicator portion is located at the outermost end of the hook shaped recess D.

When the wedge F is fully retracted (see FIG. 1) the follower 15 engages at an end part of the surface 18 of the profile of the cam 14. In this position the indicator portion 17 of the lever is engaged behind a wall 21 which hides the indicator portion 17 from the view of the operator.

The wall 21 can, in a preferred form of the invention, be formed as an integral part of the coupler body or body part H. In another form of the invention the wall 21 could be a part that is fitted to the body or body part of the quick coupler.

FIGS. 4 to 8 of the drawings show a second embodiment of the indicator 10. Parts of this second embodiment that correspond with those of the first embodiment of FIGS. 1 and 2 carry the same reference numerals.

The second embodiment includes an overload mechanism 36 (described below) which is operative to mitigate damage to the indicator in the event that the indicator lever 11 becomes jammed for some reason (either by debris or damage to the indicator or coupler) and the cylinder is continued to operate while changing attachments.

According to the second embodiment the cam profile 14 which is mounted to (or is preferably formed integrally with) a mounting 26. The mounting 26 is spring loaded. In the preferred form as shown in the drawings a pair of springs 27 are used. Each spring 27 is located at one end in a recess 28 in the underside of the mounting 26. The other ends of the springs 27 are located in recesses 29 in the floor of the recess 30 in the top of the indicator lever.

Figures 16, 17:
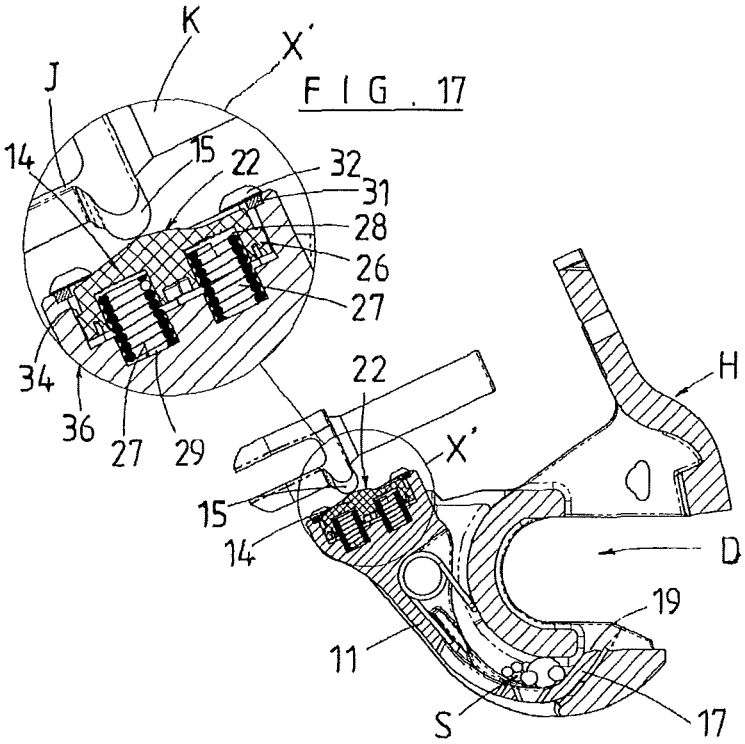
FIG. 16 is a sectioned side elevation view similar to FIG. 12 but showing the overload mechanism activated as the cylinder extends and retracts when something (e.g. debris) prevents the indicator from indicating (i.e. zero or partial indication)
FIG. 17 is detail X' of FIG. 16.

The mounting 26 and cam profile 14 are able to move as a unit in the recess 30 against the bias of the springs 27 (see FIG. 17) in the event that the lever 11 becomes jammed e.g. due to the presence of debris S (see FIG. 16).

The cam profile 14 and mounting 26 are retained in the recess 30 by a cover 31 which is removably retained by fasteners 32. The cover 31 has a slot or opening 33 through which the cam profile 14 can project. The ledge 34 formed by the mounting 26 projecting from the peripheral side edge of the cam profile 14 engages with the cover 31 so as to limit the extent of movement of the cam profile under the force of the springs 27.

A spring 35 (e.g. a coil spring) is mounted by legs 37 to the lever 11. Leg 38 of the spring 35 engages against a surface of the part of the coupler A that forms hook shaped recess D. The lever 11 is thus loaded to pivot about pivot 12 so that there is a positive contact between the follower 15 and the cam profile 14.

The indicator according to this second embodiment is shown in FIGS. 9 to 17 and will hereinafter be described in the following description of the indicator and its operation in conjunction with the coupler A.

Figures 9, 10, 11:
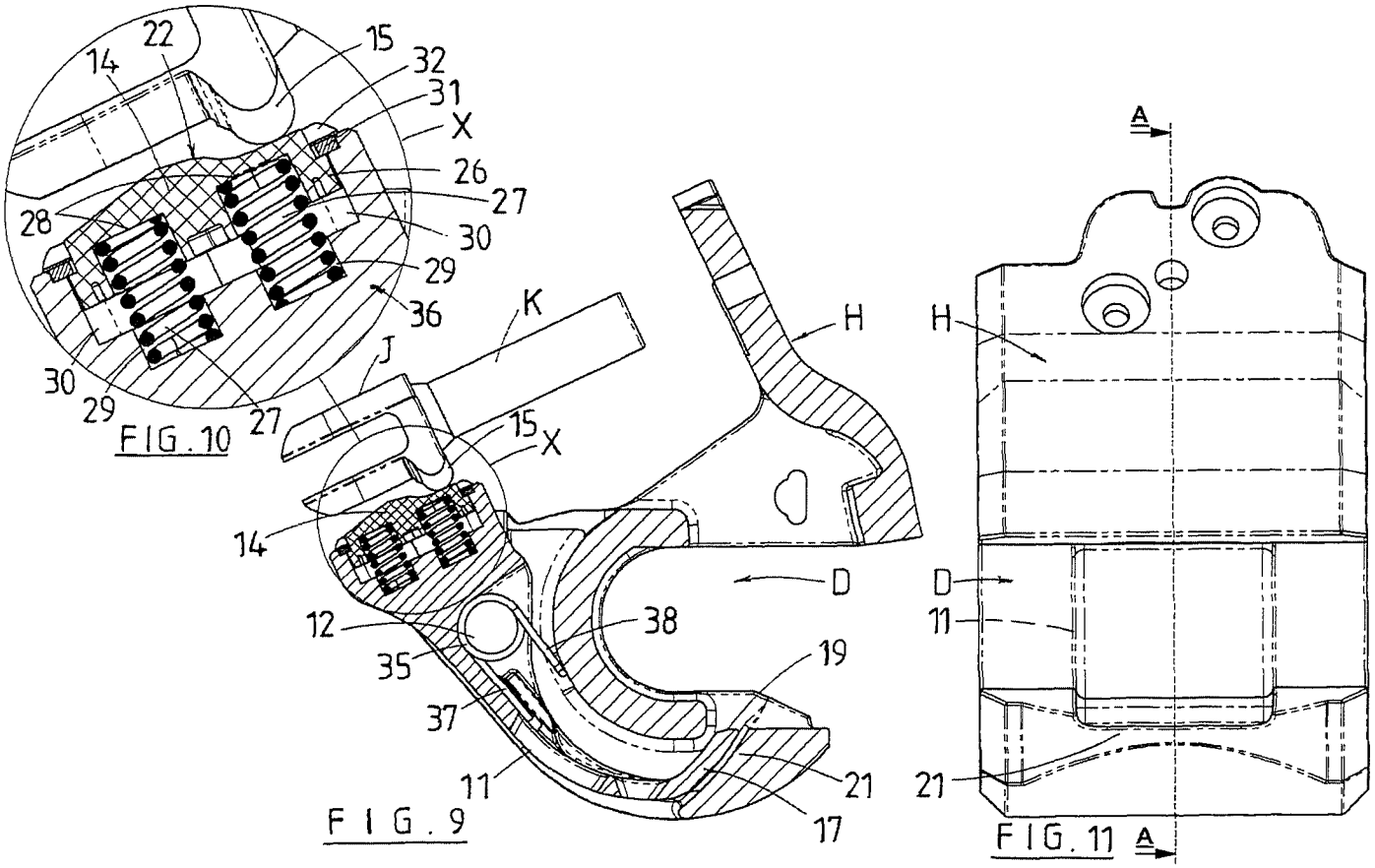
FIG. 9 is a sectioned side elevation view (on line A-A of FIG. 11) of the parts of the coupler which has the hook shaped or front recess, the piston rod of the hydraulic cylinder which controls movement of the wedge, the coupling for coupling of the wedge to the piston rod, and the embodiment of the indicator shown in FIGS. 4 to 8, the drawing showing the wedge coupling in a position that corresponds to the cylinder in the fully retracted position and the attachment un-locked.
FIG. 10 is the detail X indicated in FIG. 9 showing an overload mechanism in its pre-loaded position.
FIG. 11 is a front elevation of the arrangement shown in FIG. 9.

FIGS. 9 and 10 show the piston rod K in the position which corresponds to the cylinder of the coupler retracted and the excavator attachment un-locked. The follower 15 is shown as being located on the first or lead-in section of the cam profile 14. As is apparent from FIGS. 9 and 11 the indicator portion 17 is not visible (i.e. zero indication).

Figure 12:
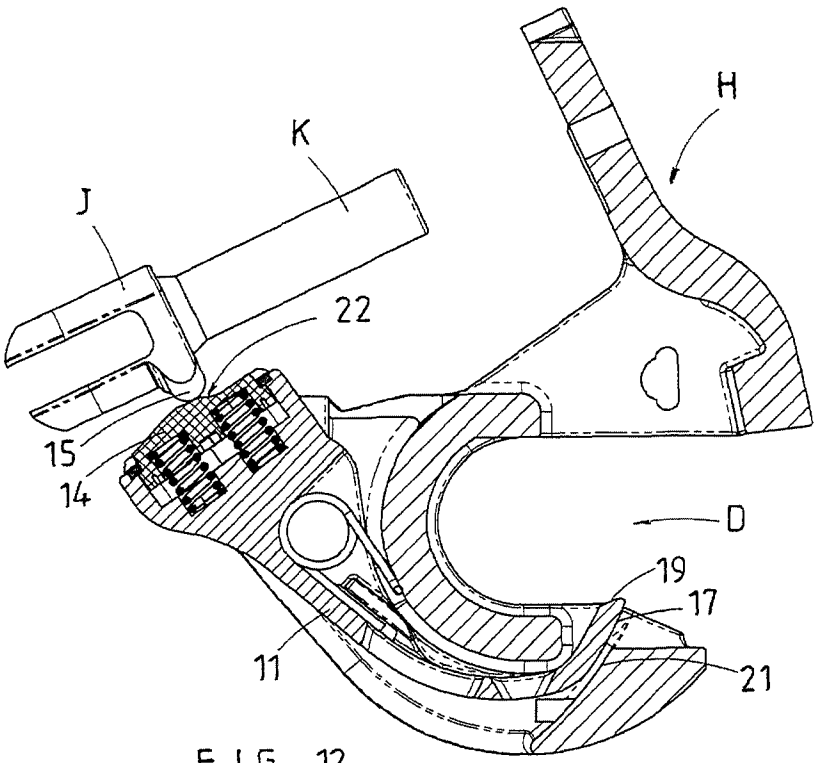
FIG. 12 is a sectioned side elevation view similar to FIG. 10 but showing the wedge coupling in a position that corresponds to the cylinder partially extended and the attachment locked, the indicator visually indicating that the wedge is in an engaged and locked position with the rear pin of the attachment.
Figure 15:
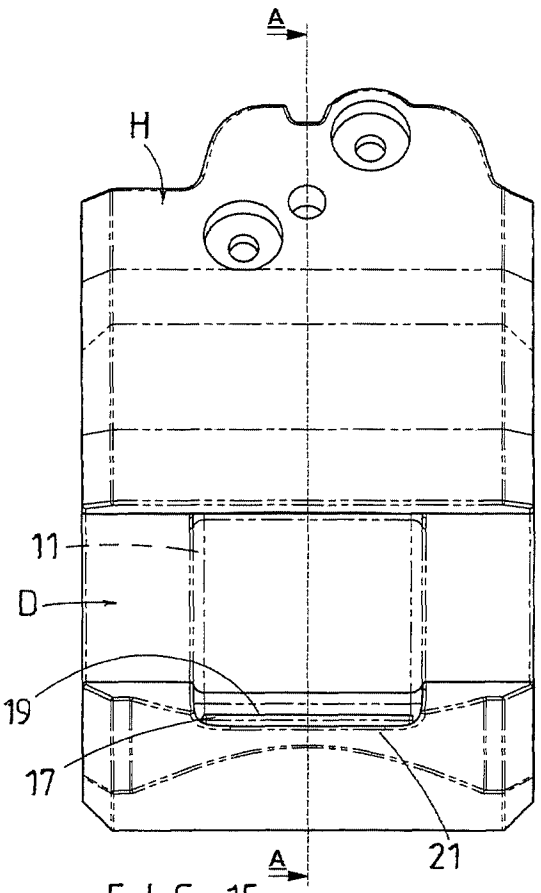
FIG. 15 is a front elevation view of the arrangement as shown in FIG. 14.
Figure 14:
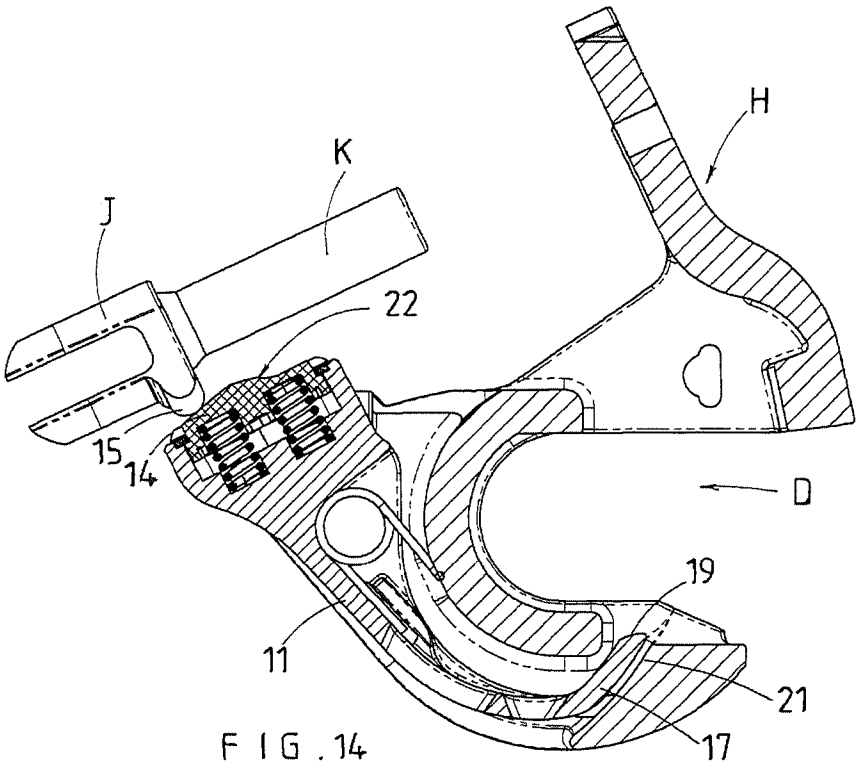
FIG. 14 is a view similar to FIG. 12 but showing the wedge coupling in a position that corresponds to the cylinder extended and the attachment un-locked with the indicator not visible or only partially visible.

When the wedge F is partially extended from its retracted position the follower 15 will move along the first section of the profile of the cam 14 until it comes into contact with the sloped area 22 (see FIG. 12). The first section of the profile of the cam 14 is designed such that the lever 11 does not substantially move about the axis of the pivot 12. As a result the indicator portion 17 does not project above the top of the wall 21, however, when the follower has reached the sloped area 22 the indicator portion 17 will have started to appear above the wall 21 as is apparent from FIGS. 12 and 13.

During movement of the follower 15 along the sloping section 22 of the profile of the cam 14 the lever 11 will continue to pivot about pivot 12 such that the indicator portion 17 will project further above the top of the wall 21. By the time that the follower 15 reaches the end of the sloping section 22 the indicator portion 17 will have moved to its full projection above the top of the wall 21 which indicates to the operator that the wedge is engaged and locked with the rear pin of the attachment.

This extent of projection of the indicator portion 17 will continue until the follower 15 has reached substantially a point along the profile of the cam 14 which corresponds to the limit of extension of the wedge F that would be expected to reach for full engagement of the pin P2 in the rear recess E of the coupler. It will be appreciated by the skilled addressee that sufficient extension of the wedge F to lock the pin in the recess E may occur anywhere along the profile of the slope 22 depending on factors such as the diameter of the pin, extent of wear of the distal end of the wedge etc.

Beyond the highest part of the profile of the cam 14 the profile slopes away and this will allow the lever 11 to pivot about pivot 12 so that the indicator portion 17 once again drops down (see FIGS. 14 and 15) until the end of the profile 14 (or that point on the profile 14) which corresponds to full stroke of the hydraulic cylinder moving the wedge F. The indicator portion 17 will not be visible or at least only partly visible (see FIGS. 14 and 15) to the operator.

Figure 13:
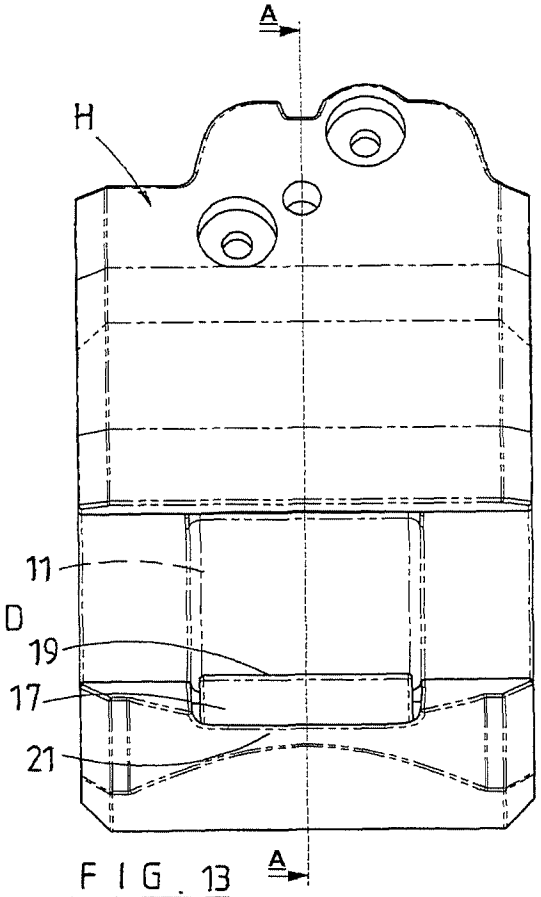
FIG. 13 is a front elevation view of the arrangement as shown in FIG. 12.

In the preferred form of the indicator the surface 25 of the indicator portion 17 which faces the operator (see e.g. FIGS. 12 and 13) is provided with coloured sections. One coloured section will be visible to the operator when the indicator portion 17 is above the wall by the extent shown in FIGS. 14 and 15. The other coloured section will be visible when the wedge F is engaged and locked with the pin P2 e.g. as shown in FIGS. 12 and 13.

In the event that the pin has not been properly located in the recess E the wedge will move to full extension (i.e. FIG. 14) because the pin P2 will not be located between the wedge F and the surface of the recess E which would otherwise result in the wedge ceasing movement somewhere corresponding to the follower being engaged with the sloping portion 22. The operator therefore will have a clear indication that engagement of the pin has not occurred because the indicator portion 17 will have lowered so that only the first coloured section is visible. The operator can then retract the wedge F and correctly locate the pin P2 in the recess E before once again extending the wedge.

Figure 18:
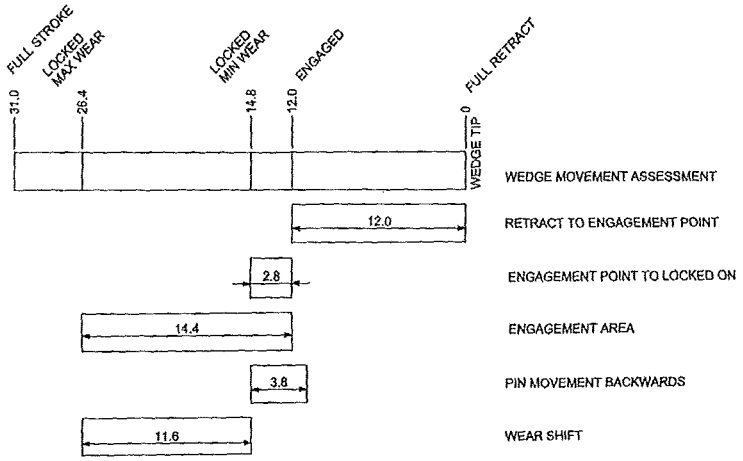
FIG. 18 is a graphic illustration showing positions of the wedge coupling during movement of the wedge from fully retracted to fully extended.

Referring now to FIG. 18 there is shown graphically a typical extent of movement of the wedge F and corresponding positions along the profile of the cam 14.

In the event that the lever 11 becomes jammed and cannot move the overload mechanism comes into play. The lever 11 could, for example, become jammed due to the presence of debris S as shown in FIG. 16. As a consequence the lever 11 will not move (or move fully) and the follower 15 will force the cam profile 14 (and mounting 26) to move down into the recess 30 against the biasing action of the springs 27 (see particularly FIG. 17). This will mitigate damage to the lever by limiting the force applied to the lever 11. The presence of the spring 35 will also assist in preventing or reducing damaging forces being applied to the lever 11.

The indicator according to the invention therefore provides a visual indication at the front of the coupler which will provide the operator a clear indication of whether or not the wedge F of the coupler has extended and engaged (locked) with the pin P2 in the rear recess E. The operator will also obtain an indication that the pin and/or the wedge has become worn to the extent that the engagement is not safe or likely to be unsafe.

With the type of coupler illustrated in FIG. 1 the lever 11 with cam 14, follower 15 and wall 21 could be constructed so as to be able to be fitted to an existing coupler. Accordingly it could be possible to create retro-fit kits for existing couplers in the market.

The invention is open to modification. For example, in one modification the indicator portion 17 is not part of the lever but is a part which is driven by movement of the lever 11. In a further modification the follower 15 is on or associated with the lever 11 and the cam profile is on or associated with the coupling J.

An example of this further modification is shown in FIGS. 19 to 23. Parts/components of the coupler A and the indicator 40 according to this third embodiment which are found in the first and second embodiments are, for convenience, indicated by the same reference numerals.

Figure 19:
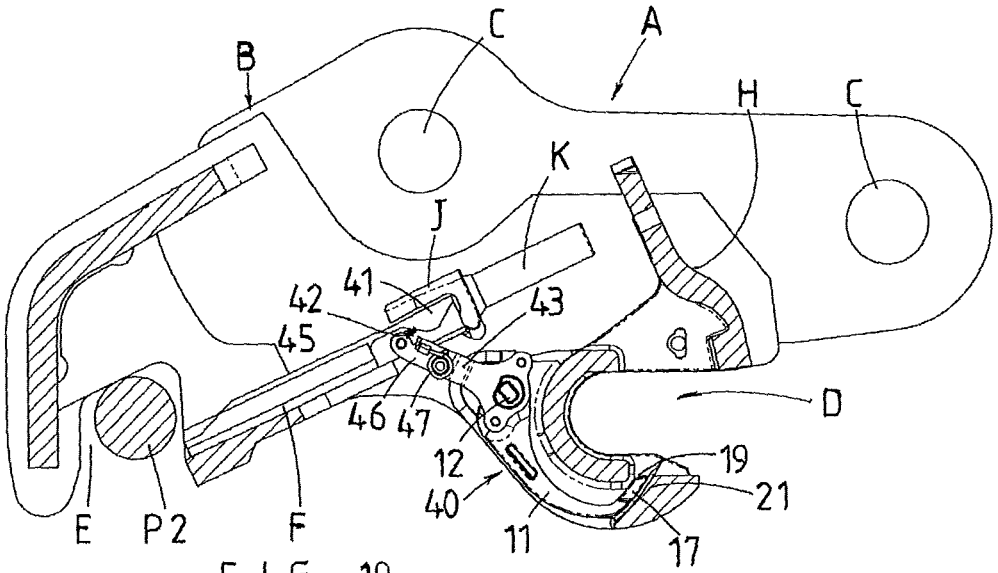
FIG. 19 is a sectioned side elevation view similar to FIG. 9 but showing a third embodiment of the indicator in conjunction with a wedge quick coupler in a state that corresponds to the wedge retracted and the attachment un-locked.

As shown, for example, in FIG. 19 a cam profile portion/part 41 is carried by or coupled to the wedge F. The cam profile 41 presents a sloping surface 42 (corresponding in function to sloping surface 22 of the first and second embodiments). A follower 45 is coupled to the top portion 13 of the lever 11.

The follower 45, like the other embodiments, moves along the profile 22 during extension and retraction of the wedge F. Thus when the wedge F is retracted (see FIG. 19) the follower 45 is at on end of the sloping surface 22 whereas when the wedge F is extended (and the pin P2 is captured in the recess E) the follower 45 is at the other end of the surface 22 (see FIG. 20). As with the other embodiments the indicator portion 17 is moved so as to be visible to the operator.

Figure 21:
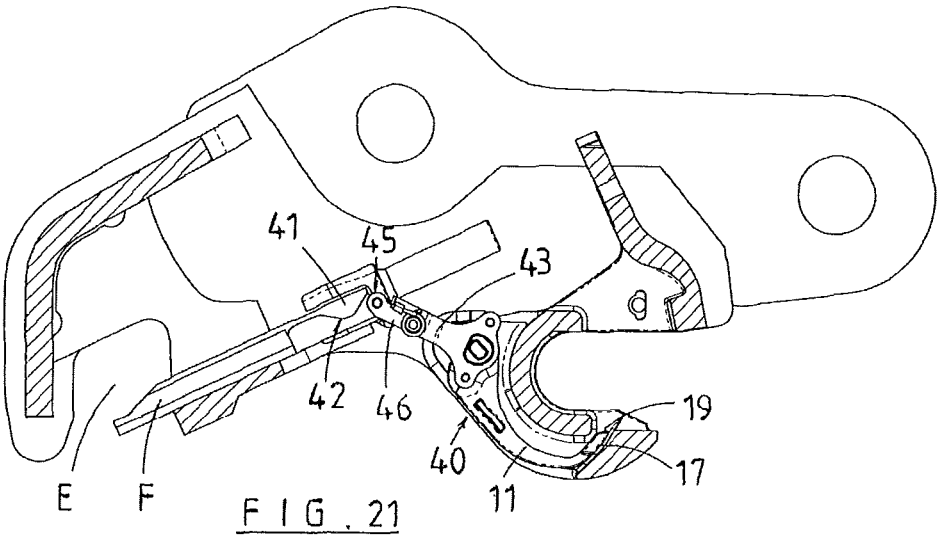
FIG. 21 is a sectioned side elevation view similar to FIG. 19 but showing quick coupler in a state that corresponds to the wedge extended and the attachment un-locked.

FIG. 21 shows the situation where the wedge F has extended and failed to capture the pin P2. In this state the follower 45 will have moved to the position shown in FIG. 21 so that the indicator portion 17 is not visible or at best is only partially visible.

Figures 22, 23:
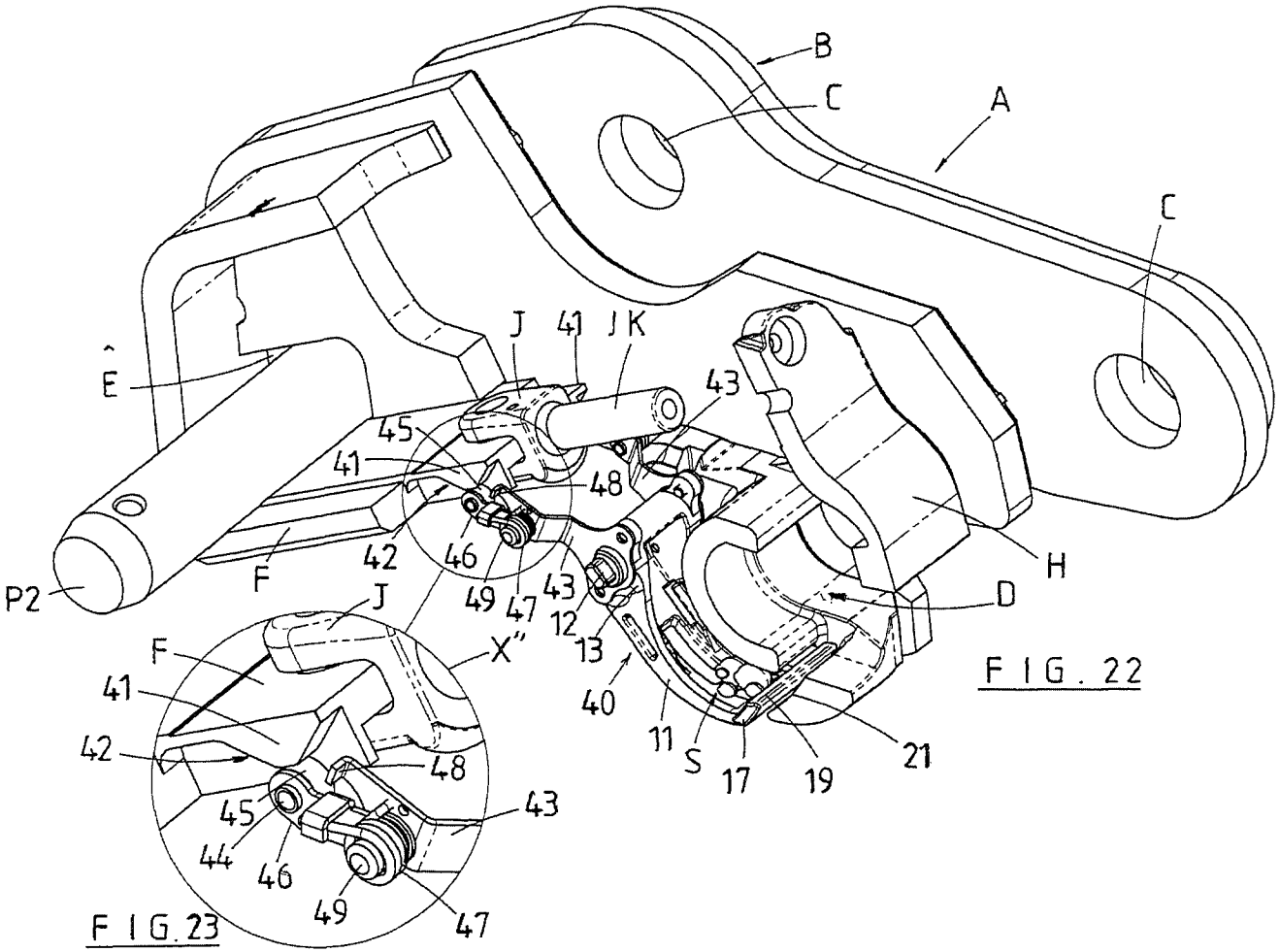
FIG. 22 is a sectioned isometric view showing the third embodiment of the indicator in conjunction with a wedge quick coupler in a state that corresponds to the wedge extended and the attachment locked.
FIG. 23 is detail X''' of FIG. 22.

The follower 45 is in a preferred form coupled to the lever 11 by a mounting 43 which is fixed to the lever 11 so as to be moveable in response to pivoting movement of the lever 11. FIG. 22 shows how there are a pair of mountings 43 (one either side of the lever 11) with the followers 45 carried thereby being engaged with respective separate cam profiles 41 attached to the wedge F.

The third embodiment shown in FIGS. 19 to 23 also has an overload mechanism. As shown more clearly in FIGS. 22 and 23 the overload mechanism is formed by an arm 46 which is pivotally coupled at 47 to the mounting 43 and connected to the follower 45 at the other end. The follower 45 can be a roller rotatably coupled by a pin, axle or the like 44 to the arm 46.

Figure 20:
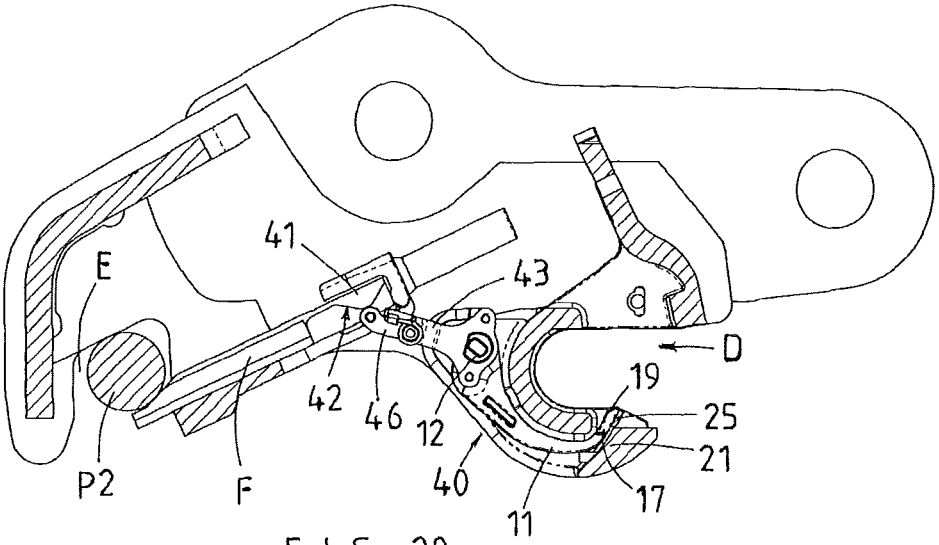

A spring 47, mounted by a spigot 49 projecting transversely to the mounting 43) biases the arm 46 into engagement with a stop 48 at or near the end of mounting 43 (see FIGS. 19 to 21). However, in the event that debris S is present (see FIG. 22) which impedes the correct movement of the lever 11 the tension in the spring 47 will be overcome and the arm 46 will "break away" as shown in FIGS. 22 and 23 so as to prevent or at least mitigate damage to the indicator 40.

It will be appreciated that this third embodiment is also open to modification. For example, the separate mountings 43 could be formed as an integral part of the top of the lever 11 or could be made as a single moulding or casting which is fixed to the top 13 of the lever 11. Other modifications will be apparent to the skilled person.

The present invention has been described and illustrated by way of a specific embodiment, and the embodiment has been described in detail in relation to a known quick coupler. It is not the intention of the Applicant to restrict or in any way limit the scope of the invention to such detail.

Additional advantages and modifications will be readily apparent to those skilled in the art. Therefore, the invention in its broader aspects is not limited to the specific details, representative means of manufacture and method, and illustrative examples shown and described. Accordingly, departures may be made from such details without departure from the spirit or scope of the Applicant's general inventive concept.

The invention claimed is:

1. An indicator which includes a combination of a profiled surface and a follower one of which is adapted to be coupled to a movable pin engagement element of a quick coupler and the other of which is coupled to a visual indicator that is adapted to, in use, be movable in response to relative movement occurring between the profiled surface and follower, the profiled surface is of a profile whereby upon movement of the pin engagement element to engage with a pin of an attachment the visual indicator is caused to provide a positive visual indication that the pin engagement element has engaged with the pin, wherein the profiled surface is profiled whereby upon the pin engagement element failing to engage with the pin the visual indicator is caused to provide a negative visual indication that indicates that engagement with the pin has failed, where the pin engagement element can move between a retracted and over-extended position, where at the over-extended position the negative visual indication is indicated and the pin cannot be engaged.

2. An indicator as claimed in claim 1 wherein the profiled surface is coupled to the visual indicator by a sprung overload mechanism which is actuated only in the event that movement of the visual indicator in response to said relative movement between the profiled surface and the follower is impeded, thus allowing the movable pin engagement element to move regardless of the location or impeded movement of the visual indicator.

3. An indicator as claimed in claim 1 wherein the follower is coupled to the visual indicator by a sprung overload mechanism which is actuated only in the event that movement of the visual indicator in response to said relative movement between the profiled surface and the follower is impeded, thus allowing the movable pin engagement element to move regardless of the or impeded movement of the visual indicator.

4. A quick coupler comprising a recess to receive a pin, a movable pin engagement element to engage the pin of an attachment in the recess, and an indicator to indicate the extent of extension of the pin engagement element, the indicator comprising a profiled surface and a follower one of which is coupled to the movable pin engagement element and the other of which is coupled to a visual indicator that is movable in response to relative movement occurring between the profiled surface and follower during movement of the pin engagement element, the profiled surface is of a profile whereby upon movement of the pin engagement element, to engage a pin of an attachment with the quick coupler to a) a partially extended position where the visual indicator is caused to provide a negative visual indication to indicate that the pin engagement element has not engaged with the pin, b) an over-extended position where the pin cannot be engaged, where the visual indicator is caused to provide a negative visual indication to indicate that the pin engagement element has not engaged with the pin, and c) an extended position intermediate the partially extended position and over-extended position, where the visual indicator is caused to provide a positive visual indication to indicate that the pin engagement element has engaged with the pin.

5. A quick coupler as claimed in claim 4 wherein the profiled surface is profiled whereby upon the pin engagement element failing to engage with the pin the visual indicator is moved to a position that indicates that engagement with the pin has failed.

6. A quick coupler as claimed in claim 4 wherein the profiled surface is coupled to the visual indicator by an overload mechanism which is operative in the event that movement of the visual indicator in response to said relative movement between the profiled surface and the follower is impeded, thus allowing the movable pin engagement element to move regardless of the location or impeded movement of the visual indicator.

7. A quick coupler as claimed in claim 4 wherein the follower is coupled to the visual indicator by an overload mechanism which is operative in the event that movement of the visual indicator in response to said relative movement between the profiled surface and the follower is impeded, thus allowing the movable pin engagement element to move regardless of the location or impeded movement of the visual indicator.

8. An indicator as claimed in any claim 6 or 7 wherein the profiled surface is coupled to a pivotally mounted lever.

9. An indicator as claimed in claim 8 wherein the lever is connected to the visual indicator.

10. An indicator as claimed in claim 9 wherein the visual indicator is formed as an integral part of the lever.

11. An indicator as claimed in claim 10 wherein a distal end part of the lever forms the visual indicator.

12. A quick coupler as claimed in claim 11 wherein the movable pin attachment element is a movable wedge driven by an hydraulic mover and the follower is connected to a coupling which couples the wedge to a hydraulic mover of the coupler.

13. A quick coupler with a recess configured to receive a pin of an attachment, the coupler comprising a movable pin engagement element configured to extend between a retracted position where the recess can receive the pin, to an over-extended position where the pin engagement element cannot engage the pin within the recess, and an indicator comprising a follower and a profiled surface with which the follower is engaged, a visual indicator, the follower is coupled to one of the movable pin engagement element or the visual indicator, the profiled surface is coupled to the other of the visual indicator or movable pin engagement element, the visual indicator is mounted to be movable in response to relative movement occurring between the profiled surface and follower during movement of the movable pin engagement element, the profiled surface is configured to provide a profile whereby upon movement of the movable pin engagement element to a position where it engages a pin of an attachment within the recess to the quick coupler, the visual indicator is caused to provide a visual indication that the pin engagement element has engaged with the pin and the profiled surface is further profiled whereby upon the movable pin engagement element failing to engage with the pin the visual indicator is moved to a position that indicates that engagement with the pin has failed, wherein engagement failure is at least indicated when the movable pin engagement element is at the over-extended position.

14. A quick coupler as claimed in claim 13 wherein the profiled surface is coupled to the visual indicator by an overload mechanism which is operative in the event that movement of the visual indicator in response to said relative movement between the profiled surface and the follower is impeded, allowing the movable pin engagement element to move regardless of the location or impeded movement of the visual indicator.

15. A quick coupler as claimed in claim 14 wherein the profiled surface is coupled to a pivotally mounted lever and the visual indicator is formed as an integral part of the lever.

16. A quick coupler as claimed in claim 14 wherein the overload mechanism includes a mounting to which the profiled surface is coupled and the mounting is coupled to the visual indicator to be movable relative to the visual indicator against the action of biasing means, allowing the movable pin engagement element to move regardless of the location or impeded movement of the visual indicator.

17. A quick coupler as claimed in claim 15 wherein a distal end of the lever forms the visual indicator.

18. A quick coupler as claimed in claim 17 wherein there is included a wall behind which obscures at least part of the visual indicator when the pin engagement element has failed to engage with the pin.

19. A quick coupler as claimed in claim 18 wherein the movable pin attachment element is a movable wedge.

20. A quick coupler as claimed in claim 4 or claim 13, wherein the pin engagement element can move irrespective of the location of the visual indicator.

* * * * *